US007850585B1

(12) United States Patent
Barboza

(10) Patent No.: US 7,850,585 B1
(45) Date of Patent: Dec. 14, 2010

(54) EXERCISE APPARATUS

(76) Inventor: Rafael A. Barboza, 2371 SW. 18th St., Miami, FL (US) 33145

( * ) Notice: Subject to any disclaimer, the term of this patent is extended or adjusted under 35 U.S.C. 154(b) by 131 days.

(21) Appl. No.: 12/021,361

(22) Filed: Jan. 29, 2008

(51) Int. Cl.
*A63B 21/04* (2006.01)

(52) U.S. Cl. ..... 482/130; 482/904

(58) Field of Classification Search ..... 482/91, 482/121, 122, 123, 124, 125, 126, 127, 128, 482/129, 130, 134, 135, 139, 148, 904, 908, 482/910; 297/217.1, 468, 470, 471, 485; 180/268, 271; 280/727, 801.1
See application file for complete search history.

(56) References Cited

U.S. PATENT DOCUMENTS

| | | | | |
|---|---|---|---|---|
| 3,440,602 | A * | 4/1969 | Frig | 340/457.1 |
| 4,013,287 | A * | 3/1977 | Dickman | 482/129 |
| 4,402,504 | A | 9/1983 | Christian | |
| D301,271 | S | 5/1989 | Greenfeld et al. | |
| 4,913,423 | A * | 4/1990 | Farran et al. | 482/130 |
| 5,141,482 | A * | 8/1992 | Hern | 482/130 |
| 5,431,617 | A | 7/1995 | Rattray, Jr. | |
| 5,558,608 | A * | 9/1996 | Hall | 482/129 |
| 5,614,300 | A | 3/1997 | Cicali et al. | |
| 5,626,546 | A | 5/1997 | Little | |
| 6,183,403 | B1 * | 2/2001 | Dunn | 482/121 |
| 6,500,103 | B2 * | 12/2002 | Porter | 482/121 |
| 6,500,104 | B1 * | 12/2002 | Rich | 482/123 |
| 7,083,555 | B1 * | 8/2006 | McPartland | 482/140 |
| 7,229,392 | B2 * | 6/2007 | Turnbull et al. | 482/129 |
| 7,381,170 | B2 * | 6/2008 | Oz | 482/140 |
| 7,625,325 | B1 * | 12/2009 | Yost | 482/129 |
| 7,651,134 | B2 * | 1/2010 | Rosso | 280/801.1 |
| 7,699,762 | B2 * | 4/2010 | Turnbull et al. | 482/130 |
| 7,727,131 | B2 * | 6/2010 | Longo | 482/124 |
| 2004/0254049 | A1 * | 12/2004 | Martien | 482/121 |
| 2005/0009676 | A1 * | 1/2005 | Turnbull et al. | 482/133 |
| 2005/0046168 | A1 * | 3/2005 | Simpson | 280/801.1 |
| 2005/0143231 | A1 * | 6/2005 | Turnbull et al. | 482/121 |
| 2010/0173759 | A1 * | 7/2010 | Lalaoua | 482/121 |

* cited by examiner

*Primary Examiner*—Loan Thanh
*Assistant Examiner*—Daniel F Roland
(74) *Attorney, Agent, or Firm*—Crossley Patent Law; Mark A. Crossley

(57) ABSTRACT

The exercise apparatus has a plurality of flat belt-shaped elastomeric resistance bands provided in like or differing elastomeric resistance and like or differing lengths. A specifically designed rectangular mounting bracket is provided for each band end. Each rectangular bracket is designed to be mounted to an existing truck seat base mount, with existing fasteners or otherwise available fasteners, so that a trucker can exercise privately and effectively when experiencing any downtime in travels. The brackets are not limited to seat base attachment only. The apparatus is especially effective for abdominal and lumbar muscle activity.

20 Claims, 3 Drawing Sheets

EXERCISE APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

A variety of personal exercise devices have been offered which target muscles of the abdomen and lower back. Problems with such devices include complexity, expense, immobility, anchoring issues, and use. Many are overly complex and therefore expensively produced and sold. Some abdominal and lumber devices are not easily adapted to mounting in more than one location, whereby the devices may be easily dismounted then remounted elsewhere. Many involve pulleys and other movable interactive parts, which also add to expense in production and sale and to use difficulty in confined environs. Some such devices require a user to be strapped in before the exercise/s can be performed. To date, no device has been available which is particularly suited to the needs of a truck driver, especially one who is habitually on the road and has no time or place for strengthening the above referenced muscles or even others. What is needed is an apparatus which provides a means for truck drivers to strengthen and tone their abdominal and lumbar muscles during downtime when between destinations. The apparatus should be compact, easily used, and easily and removably installed in a truck's cab for exercising in privacy. Further, such device should be basic and affordable. And, the apparatus should include no interactive moving parts whereby pulleys and the like are employed. The apparatus should be easily employed in varying degrees of resistance. The apparatus should require movement and therefore not involve isometric exercise. And, of significant importance, the apparatus should provide for exercising both abdominal and lumber muscles, as well as other chosen muscle groups. The present exercise apparatus addresses the foregoing needs by being an affordable, convenient, lightweight, compact device which is easily installed in a truck cab to use for strengthening and toning an individual's abdominal and lumbar muscles in privacy.

FIELD OF THE INVENTION

The present exercise apparatus relates to exercise devices and, more specifically, to an exercise apparatus designed especially for truck drivers to strengthen and tone abdominal and lumbar muscles.

SUMMARY OF THE INVENTION

The general purpose of the exercise apparatus, described subsequently in greater detail, is to provide a exercise apparatus which has many novel features that result in an improved exercise apparatus which is not anticipated, rendered obvious, suggested, or even implied by prior art, either alone or in combination thereof.

To attain this, the present exercise apparatus is comprised of three separate elasticized resistance bands. The bands are provided in varying degrees of tension, including light, medium and heavy tension. The belt-shaped bands may be used either separately or in any combination. The flat belt-shaped bands prevent damage to a truck's seats and interior which might otherwise be incurred with round elasticized bands which are inherently more invasive and abrasive, and also prone to entanglement with interior objects. The belt-shaped bands also provide best grip without endangering a user's hands. The ends of each band are secured to a specially designed rectangular mounting bracket with inverted right-angled u-shaped eyelet. Each bracket features a slightly off center perforation designed for mount to the seat base mountings of a typical truck cab using existing seat mount fasteners. The bracket design further provides for mount to a seat side panel or to the floor of the cab. Such existing truck cab mounting points are largely universal, allowing the apparatus to be used in a large variety of truck cabs. The apparatus can therefore be easily added to or removed from a given truck cab. Additionally, the mounting brackets also allow the bands to be easily secured to a home floor or wall or other such structure.

The present exercise apparatus may be used by a trucker during downtime between destinations. Once the present exercise apparatus is installed within a truck cab, a driver is able to sit between the truck's two seats, lean forward, grasp one or more of the resistance bands, and pull against the offered resistance, attempting to sit upright in a motion similar to a reverse-sit-up or rowing motion, thereby stretching the abdominal muscles and taxing lumber muscles. Lumbar muscle strength combats lower back problems and pain. The apparatus may also be used in reverse, whereby the user reverses position relative to the bands.

The user may grasp the bands behind the back, then work against band tension while curling the torso's abdominal muscles into contraction and stretching the lumbar muscles. Given the bands' tension variation, each or any combination of bands also offers resistance for other exercises that a user might choose, such as arm curls, triceps extensions, upright row, and the like. The apparatus is therefore not limited to only abdominal and lumber strengthening exercises within the truck cab.

The present exercise apparatus helps truck drivers combat the sedentary effects of their jobs. The apparatus also ultimately assists individuals in leading a healthier overall lifestyle and possibly increased self-esteem. Use of the present exercise apparatus also releases endorphins into the user's body and assists keeping a trucker driver more focused and alert, thereby increasing safety on the roadways. Alternative embodiments are provided in home and in office versions.

An object of the exercise apparatus is to provide movable resistance for a truck driver to strengthen and tone abdominal and lumbar muscles during downtime.

An object of the exercise apparatus is to provide for the performance of other muscle group exercises within the confines of a truck cab.

Another object of the exercise apparatus is to provide an exercise apparatus which is for compact use in a truck cab.

An added object of the exercise apparatus is to be easily mounted to and dismounted from a truck's seat mounts.

And, an object of the exercise apparatus is to provide only elastomeric resistance bands and no other moving parts.

Another object of the exercise apparatus is to offer variable resistance.

Further, an object of the exercise apparatus is to be easy on a user's hands.

Another object of the exercise apparatus is to negate damage to a truck's interior.

Yet another object of the exercise apparatus is to be basic and therefore affordable to virtually any user.

Still yet another object of the exercise apparatus is to encourage the release of endorphins into a user's body.

A further object of the exercise apparatus is to assist a user in maintaining focus and alertness, thereby increasing driver safety.

Thus has been broadly outlined the more important features of the improved exercise apparatus so that the detailed description thereof that follows may be better understood and in order that the present contribution to the art may be better appreciated.

These together with additional objects, features and advantages of the improved exercise apparatus will be readily apparent to those of ordinary skill in the art upon reading the following detailed description of presently preferred, but nonetheless illustrative, embodiments of the improved exercise apparatus when taken in conjunction with the accompanying drawings. In this respect, before explaining the current embodiments of the improved exercise apparatus in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the concept of this disclosure may be readily utilized as a basis for the design of other structures, methods, and kits for carrying out the several purposes of the improved exercise apparatus. It is therefore important that the claims be regarded as including such equivalent constructions insofar as they do not depart from the spirit and scope of the present invention.

DETAILED DESCRIPTION OF THE DRAWINGS

With reference now to the drawings, and in particular FIGS. 1 through 4 thereof, the principles and concepts of the exercise apparatus generally designated by the reference number 10 will be described.

Figure 4:
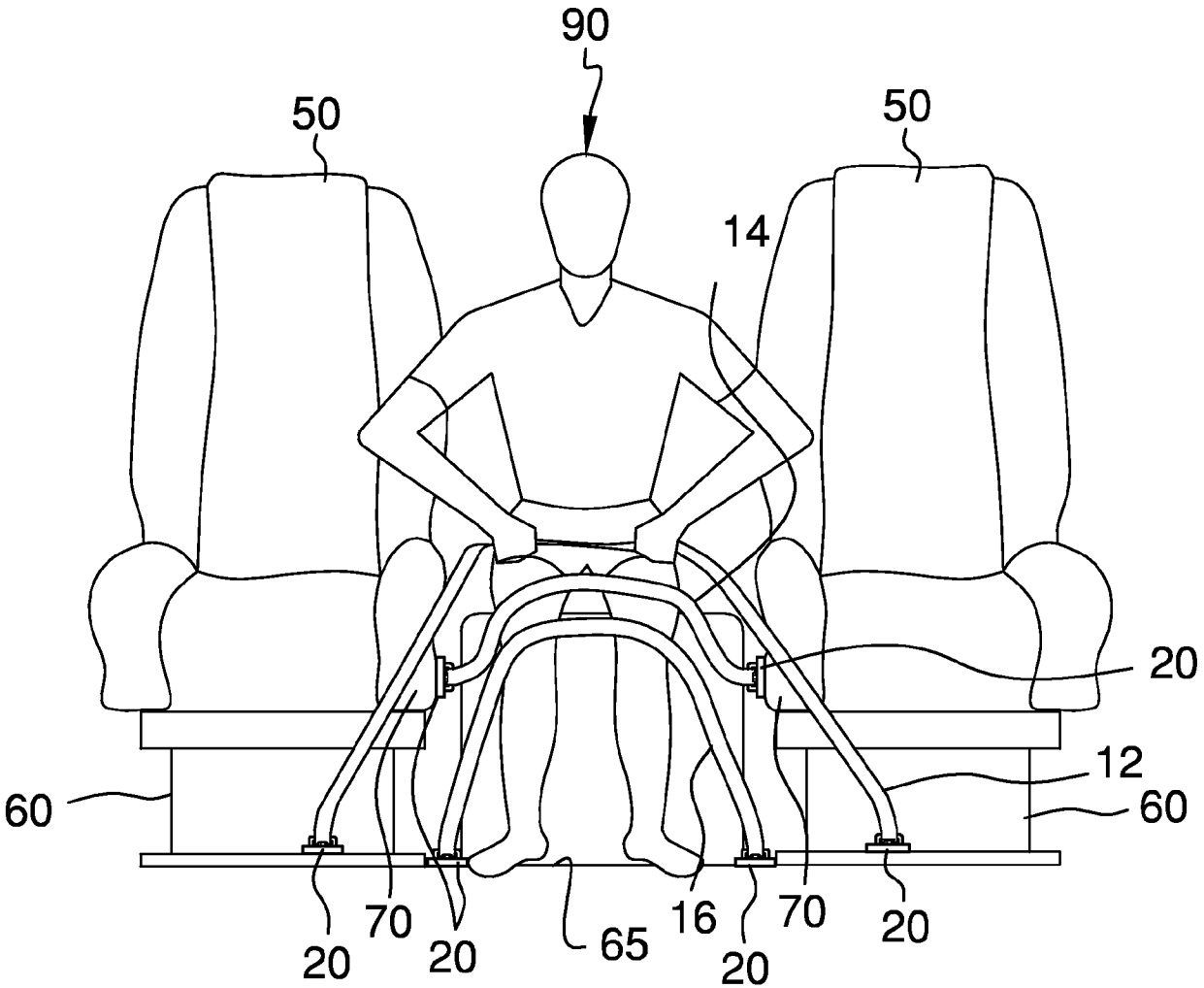
FIG. 4 is a front elevation view of the apparatus in use.

Referring to FIG. 4, each of the brackets 20 of the exercise apparatus 10 is attached to a part of the interior of a truck cab. While each bracket 20 accommodates a seat base 60 mount and complimentary fasteners 40A and 40B, each bracket 20 can also be mounted elsewhere. The brackets 20 of the first band 12 are attached to the seat bases 60 of seats 50. The brackets 20 of the second band 14 are attached to the seat side panels 70. The brackets 20 of the third band 16 are attached to the floor 65 of the interior of a truck cab. The user 90 has chosen to use only the first band 12 grasped in the user's 90 hands. The position of the user 90 can depict either an upright row exercise or a bent arm lower back tensioning/abdominal stretching exercise, for example. The user 90 has the option of grasping more or different bands, such as second band 14 and third band 16 to perform a variety of exercises. The first band 12, the second band 14 and the third band 16 are provided in various lengths 17 as per user 90 demand. For example, advanced users 90 may opt for the first band 12, the second band 14 and the third band 16 to be of equal length 17. Another user 90 may opt for the first band 12, the second band 14, and the third band 16 to be of different lengths 17, as illustrated.

Figure 1:
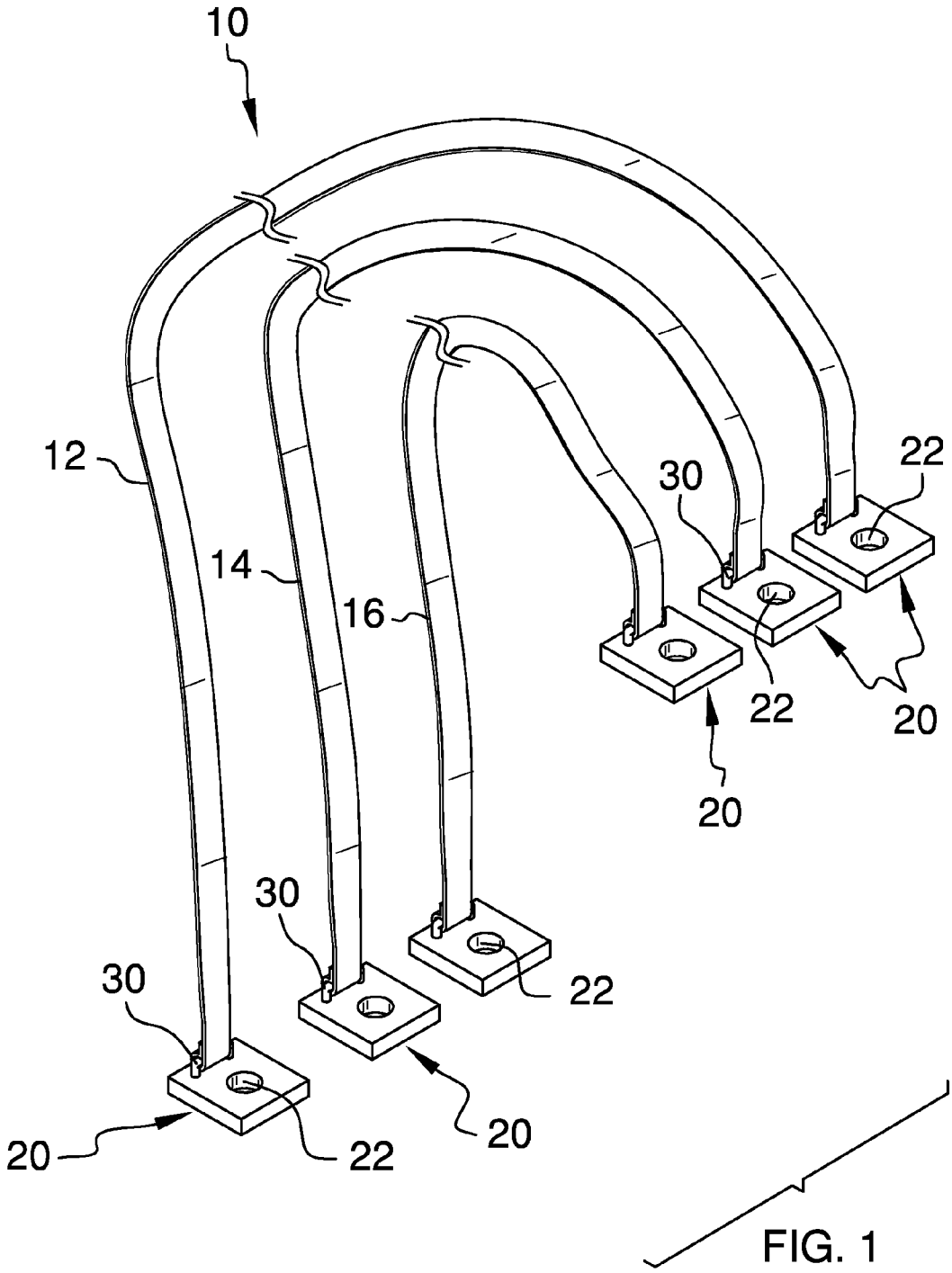
FIG. 1 is a perspective view.
Figure 2:
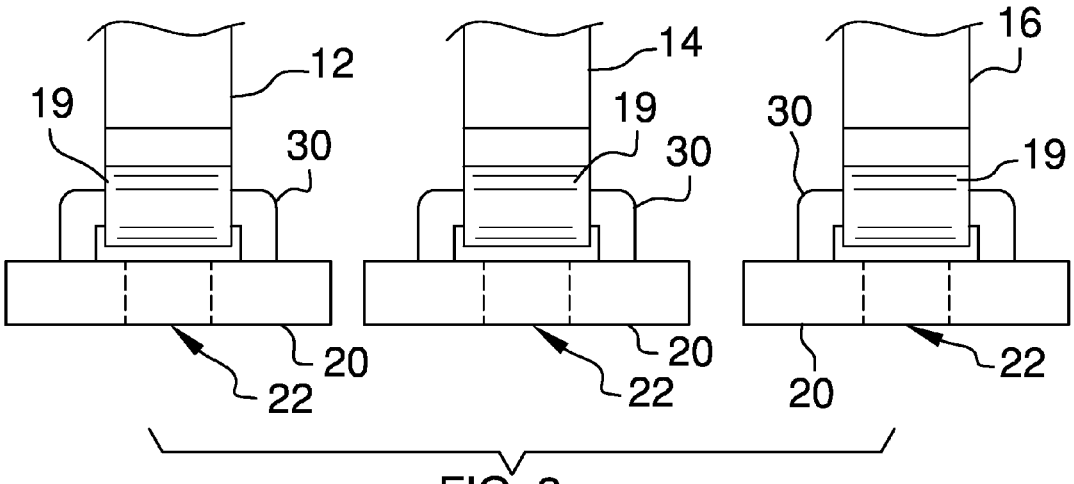
FIG. 2 is a rear elevation view of the attachment of the bands to the mounting brackets.
Figure 3:
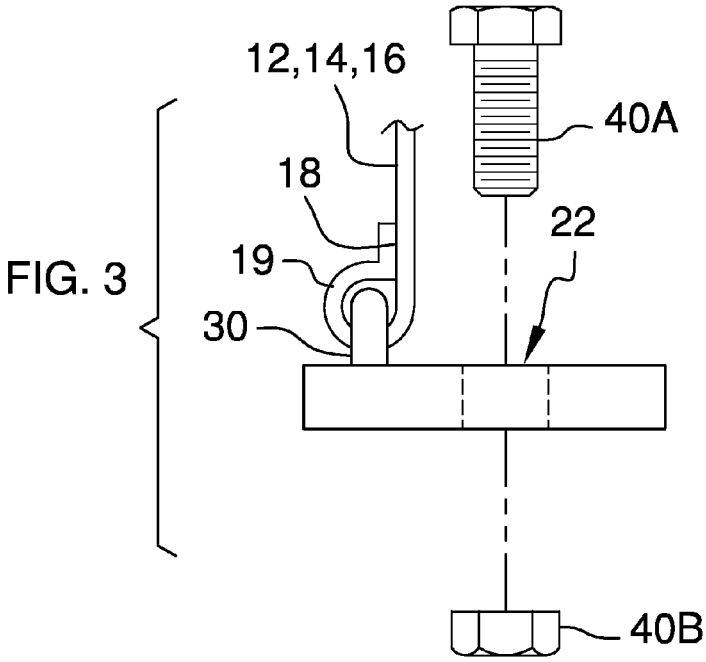
FIG. 3 is a lateral exploded elevation view of bracket mount and fastener.

Referring to FIGS. 1-3, the exercise apparatus 10 comprises the plurality of flat belt-shaped elastomeric resistance bands 12, 14, and 16, comprising the first band 12, the second band 14, and the third band 16. The first band 12, the second band 14, and the third band 16 may be provided in like or differing elastomeric resistance. The first band 12 may be of lightest elastomeric resistance, the second band 14 of medium elastomeric resistance, and the third band 16 of heavier elastomeric resistance, for example. Each of the first band 12, the second band 14, and third band 16 comprises a pair of opposed ends 13 and a length 17 therebetween. Each bracket 20 comprises a bracket first end 21 spaced apart from the bracket second end 24, and a pair of spaced apart sides 25. Each bracket 20 is flat, save the added inverted right-angled u-shaped eyelet 30. Each inverted right-angled u-shaped eyelet 30 is attached to the top 27 of the first end 21 of each bracket 20. An eyelet 30 of a bracket 20 is attached to one of the ends 13 of the first band 12, second band 14, and third band 16, respectively. Each eyelet 30 and first band 12, second band 14, and third band 16 attachment comprises a loop 19 and a bond 18 so that structural integrity of each attachment is assured. Bonds 18 may be hermetic, bonding agent, stitching, or a combination thereof. The right-angled eyelets 30 and flat belt-shaped bands 12, 14, and 16 provide for best function and long life at the eyelet/band attachments. A perforation 22 is equidistantly disposed between each side 25 of each bracket 20. Each perforation 22 is slightly offset from the center 26 toward the bracket second end 24 of each bracket 20 in order to correctly accommodate seat base 60 fastening. Other fastening points are not as critical but are accommodated by the bracket 20 design. Each bracket 20 perforation 22 is in removable receipt of an existing truck seat mount fastener comprised of complimentary fasteners 40A and 40*b*.

With respect to the above description then, it is to be realized that the optimum dimensional relationships for the parts of the exercise apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present exercise apparatus.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present exercise apparatus may be used.

Therefore, the foregoing is considered as illustrative only of the principles of the exercise apparatus. Further, since numerous modifications and changes will readily occur to those skilled in the art, it is not desired to limit the exercise apparatus to the exact construction and operation shown and described, and accordingly, all suitable modifications and equivalents may be resorted to, falling within the scope of the exercise apparatus.

What is claimed is:

1. An exercise apparatus comprising:

a plurality of elastomeric resistance bands comprising a first band, a second band, and a third band, each band comprising a pair of opposed ends and a length therebetween;

a plurality of rectangular mounting brackets, each bracket comprising a bracket first end spaced apart from a bracket second end, and a pair of spaced apart sides, each bracket further comprising:

an inverted u-shaped eyelet attached to a top of the bracket first end, one eyelet directly attached to each end of each band, respectively;

a truck cab; and a perforation disposed within each bracket, each perforation in removable receipt of a fastener mounted to an existing part of an interior of the truck cab.

2. The apparatus according to claim 1 wherein the length of the second band is further unequal to the length of the first band.

3. The apparatus according to claim 1 wherein the length of the third band is further unequal to the length of the first band.

4. The apparatus according to claim 2 wherein the length of the third band is further unequal to the length of the second band.

5. The apparatus according to claim 1 wherein the elastomeric resistance of the first band, the second band, and the third band, are further unequal.

6. The apparatus according to claim 2 wherein the elastomeric resistance of the first band, the second band, and the third band, are further unequal.

7. The apparatus according to claim 3 wherein the elastomeric resistance of the first band, the second band, and the third band, are further unequal.

8. The apparatus according to claim 4 wherein the elastomeric resistance of the first band, the second band, and the third band, are further unequal.

9. An exercise apparatus comprising:

a plurality of elastomeric resistance bands comprising a first band, a second band, and a third band, each band comprising a pair of opposed ends and a length therebetween;

a plurality of rectangular mounting brackets, each bracket comprising a bracket first end spaced apart from a bracket second end, and a pair of spaced apart sides, each bracket further comprising:

an inverted u-shaped eyelet attached to a top of the bracket first end of each bracket, one eyelet directly attached to each end of each band, respectively;

a truck cab; and a perforation disposed between each side and each end of each bracket, each perforation slightly offset from a center toward the bracket second end, each perforation in removable receipt of a fastener mounted to an existing part of an interior of the truck cab.

10. The apparatus according to claim 9 wherein the length of the second band is further unequal to the length of the first band.

11. The apparatus according to claim 9 wherein the length of the third band is further unequal to the length of the first band.

12. The apparatus according to claim 10 wherein the length of the third band is further unequal to the length of the second band.

13. The apparatus according to claim 9 wherein the elastomeric resistance of the first band, the second band, and the third band, are further unequal.

14. The apparatus according to claim 10 wherein the elastomeric resistance of the first band, the second band, and the third band, are further unequal.

15. The apparatus according to claim 11 wherein the elastomeric resistance of the first band, the second band, and the third band, are further unequal.

16. The apparatus according to claim 12 wherein the elastomeric resistance of the first band, the second band, and the third band, are further unequal.

17. An exercise apparatus comprising:

a plurality of flat belt-shaped elastomeric resistance bands comprising a first band having a first resistance, a second band of having a second resistance, and a third band having a third resistance, whereby the third resistance is greater than the second resistance, and the second resistance is greater than the first resistance, each band comprising a pair of opposed ends and a length therebetween;

a rectangular mounting bracket, each bracket comprising a first end spaced apart from a second end, and a pair of spaced apart sides, each bracket further comprising:

an inverted right-angled u-shaped eyelet attached to a top of each bracket first end, one eyelet directly attached to each end of each band, respectively, each eyelet attachment further comprising a band loop and a bond;

a truck cab;

a perforation equidistantly disposed between each side of each bracket, the perforation slightly offset from a center toward the bracket second end, each perforation in removable receipt of a fastener mounted to an existing seat base of an interior of the truck cab.

18. The apparatus according to claim 17 wherein the length of the second band is further unequal to the length of the first band.

19. The apparatus according to claim 17 wherein the length of the third band is further unequal to the length of the first band.

20. The apparatus according to claim 18 wherein the length of the third band is further unequal to the length of the second band.

* * * * *